US005217397A

United States Patent [19]

Itoh

[11] Patent Number: 5,217,397

[45] Date of Patent: Jun. 8, 1993

[54] CONNECTION CONSTRUCTION OF HIGH-VOLTAGE RESISTANCE WIRE

[75] Inventor: Hiroyuki Itoh, Yokkaichi, Japan

[73] Assignee: Sumitomo Wiring Systems, Ltd., Mie, Japan

[21] Appl. No.: 936,316

[22] Filed: Aug. 28, 1992

[30] Foreign Application Priority Data

Sep. 26, 1991 [JP] Japan ..... 3-78038[U]

[51] Int. Cl.[5] ..... H01R 4/20

[52] U.S. Cl. ..... 439/865; 439/877

[58] Field of Search ..... 174/35 SM, 72 S, 113 C, 174/131 A; 439/125, 865, 867, 877-878, 890, 893

[56] References Cited

U.S. PATENT DOCUMENTS 533,910 2/1895 Metzger ..... 439/877
1,309,887 7/1919 Fulton ..... 439/877 X
1,824,447 9/1931 Richter ..... 439/867 X
3,740,702 6/1973 Moray .
4,284,322 8/1981 Keller .
4,721,474 1/1988 Kanno et al. .
4,780,700 10/1988 Wakabayashi et al. .
4,863,391 10/1989 Mochizuki .

*Primary Examiner*—Eugene F. Desmond
*Attorney, Agent, or Firm*—Sughrue, Mion, Zinn, Macpeak & Seas

[57] ABSTRACT

A connection construction of a high-voltage resistance wire, in which an insulating coating layer is stripped from a distal end portion of the high-voltage resistance wire so as to expose a portion of a winding conductor constituted by an insulating core and a resistance wire wound around the insulating core; wherein a contact piece is mounted on the portion of the winding conductor so as to enclose the portion of the winding conductor in a state where the contact piece is pressed against the portion of the winding conductor; wherein the portion of the winding conductor is folded back onto the insulating coating layer such that the contact piece is brought into facial pressing contact with a terminal.

4 Claims, 3 Drawing Sheets

PRIOR
ART

PRIOR
ART

PRIOR
ART

PRIOR
ART

CONNECTION CONSTRUCTION OF HIGH-VOLTAGE RESISTANCE WIRE

BACKGROUND OF THE INVENTION

The present invention relates to a connection construction of a high-voltage resistance wire and more particularly, to a connection construction in which the high-voltage resistance wire is used as an ignition cord in an ignition device for an automotive engine and a terminal to be coupled with a cap, etc. of a spark plug, an ignition coil and a distributor is connected with a winding conductor exposed from a distal end portion of the high-voltage resistance wire such that proper connection between the terminal and the winding conductor is guaranteed for a long term approximately identical with service life of the engine.

In a known high-voltage resistance wire of this kind shown in FIG. 6, a winding conductor 3 having a high electric resistance is prepared by winding around an insulating core 1 a resistance wire 2 formed by a nichrome wire or the like and then, is coated by an insulating coating layer 4 formed by a thick cylindrical rubber member. One distal end of the known high-voltage resistance wire is connected to a terminal as follows. Namely, as shown in FIG. 6(*a*), the winding conductor 3 and the insulating coating layer 4 are cut to predetermined lengths for cylinder numbers of an automotive engine, respectively. Subsequently, as shown in FIG. 6(*b*), the insulating coating layer 4 is stripped, through a fixed length from its cut end, from the winding conductor 3 so as to expose a portion of the winding conductor 3. Thereafter, the exposed winding conductor 3 is folded back onto the insulating coating layer 4 as shown in FIG. 6(*c*) and then, is inserted together with the insulating coating layer 4 into a tubular terminal 5 such that the folded portion of the winding conductor 3 is pressed against an inner bottom surface of the terminal 5 as shown in FIG. 6(*d*).

In the above mentioned prior art connection method, the folded portion of the winding conductor 3 is inserted into the cylindrical terminal 5 and then, the terminal 5 is crimped so as to be pressed against the winding conductor 3 through the insulating coating layer 4 formed by the large-diameter rubber member. Thus, the resistance wire 2 of the winding conductor 3 is held in close contact with the inner bottom surface of the terminal 5.

However, in this prior art connection method, in case the rubber of the insulating coating layer 4 has been subjected to heat deterioration, elasticity of the rubber of the insulating coating layer 4 drops and contraction of volume of the insulating coating layer 4 takes place, so that a force for bringing the winding conductor 3 into pressing contact with the surface of the terminal 5, which is applied by the insulating coating layer 4, becomes insufficient. In addition, when the terminal 5 and the high-voltage resistance wire are subjected to vibrations and electric discharge, the winding conductor 3 is separated from the terminal 5 and thus, sparks are generated at the separated portion between the winding conductor 3 and the terminal 5, thereby resulting in further deterioration of the rubber of the insulating coating layer 4. Due to these causes, improper contact between the winding conductor 3 and the terminal 5 occurs.

In order to solve the above mentioned conventional problem, various countermeasures for improving contact between the winding conductor 3 and the terminal 5 have been proposed as shown in FIGS. 7(*a*) and 7(*b*). In FIG. 7(*a*), a stopper 5*a* is provided on the terminal 5 so as to be brought into contact with a folded portion 3*a* of the winding conductor 3. Meanwhile, in FIG. 7(*b*), electrically conductive epoxy coating compound 6 is applied to a contact portion between the winding conductor 3 and the terminal 5. Especially, at one distal end portion of the terminal 5 adjacent to the spark plug, which is likely to be subjected to heat deterioration, the countermeasures of FIGS. 7(*a*) and 7(*b*) are employed in combination.

Usually, proper connection between the terminal and the winding conductor of the high-voltage resistance wire of this kind is required to be guaranteed for a term approximately identical with service life of the engine of the motor vehicle. However, even if the countermeasures of FIGS. 7(*a*) and 7(*b*) are employed in combination, improper contact between the winding conductor and the terminal may happen after running of the motor vehicle for a long period. Namely, in the above mentioned known connection constructions, it is impossible to guarantee connection between the terminal and the winding conductor for a long term.

This drawback of the known connection constructions results from the following factor. Namely, as shown in FIG. 8, since the insulating coating layer 4 is formed by an elastic member, the insulating coating layer 4 having a circular cross section is not brought into point contact with the winding conductor 3 having a circular cross section. However, area of contact of the insulating coating layer 4 with the winding conductor 3 is extremely small. Likewise, since the winding conductor 3 has a circular cross section and the terminal 5 has an annular cross section, the winding conductor 3 is brought into contact, substantially at one point, with the terminal 5.

Furthermore, in the known high-voltage resistance wire having the winding conductor 3, the resistance wire 2 of the exposed winding conductor 3 is readily loosened. If the winding conductor 3 is pressed against the terminal 5 in a state where the resistance wire 2 is loosened, such a problem arises that the resistance wire 2 projects out of the finished product so as to cause leak, thereby resulting in improper ignition of the engine.

SUMMARY OF THE INVENTION

Accordingly, an essential object of the present invention is to provide a connection construction of a high-voltage resistance wire, in which areas of contact of a winding conductor with a terminal and an insulating coating layer are increased such that the winding conductor is held in proper contact with the terminal even if rubber forming the insulating coating layer has been subjected to heat deterioration.

Another important object of the present invention is to provide a connection construction of a high-voltage resistance wire, which eliminates leak due to loosening of a resistance wire of the winding conductor.

In order to accomplish these objects of the present invention, there is provided a connection construction of a high-voltage resistance wire, according to one embodiment of the present invention, in which an insulating coating layer is stripped from a distal end portion of the high-voltage resistance wire so as to expose a portion of a winding conductor constituted by an insulating core and a resistance wire wound around the insulating core; wherein a contact piece is mounted on the portion of the winding conductor so as to enclose the portion of the winding conductor in a state where the contact piece is pressed against the portion of the winding conductor; wherein the portion of the winding conductor is folded back onto the insulating coating layer such that the contact piece is brought into facial pressing contact with a terminal.

It is preferable that a pair of protrusions are formed at an intermediate portion of the winding conductor so as to project in opposite directions perpendicular to an axial direction of the winding conductor, respectively in a state where the contact piece is folded back onto the insulating coating layer. Thus, the protrusions are pressed between an outer periphery of the insulating coating layer and an inner periphery of the terminal such that area of contact between the winding conductor and the terminal is increased.

As described above, in the connection construction of the present invention, the electrically conductive contact piece having a flat platelike shape is secured to the winding conductor exposed at the distal end portion of the high-voltage resistance wire. Then, the winding conductor having the contact piece secured thereto is folded back onto the insulating coating layer. When the winding conductor, the insulating coating layer and the contact piece are inserted into the cylindrical terminal in this state, the platelike contact piece is pressed between the outer periphery of the insulating coating layer and the inner periphery of the terminal so as to be curved. As a result, since the contact piece is brought into facial contact with the terminal, area of contact between the winding conductor and the terminal can be increased through the contact piece.

Meanwhile, if the protrusions are formed on the platelike contact piece, area of contact between the winding conductor and the terminal can be further increased by area of the protrusions. Therefore, since area of contact between the winding conductor and the terminal is increased, occurrence of improper contact between the winding conductor and the terminal is lessened, so that proper connection between the winding conductor and the terminal can be ensured for a long term approximately identical with service life of the engine.

In addition, since the exposed winding conductor is completely enclosed in the contact piece, the resistance wire can be effectively prevented from being loosened from the insulating core.

BRIEF DESCRIPTION OF THE DRAWINGS

These objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
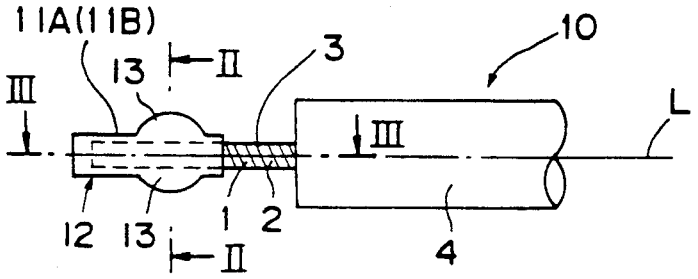
FIG. 1 is a front elevational view of a connection construction of a high-voltage resistance wire according to one embodiment of the present invention, in which a contact piece is attached to the high-voltage resistance wire.
Figure 2:
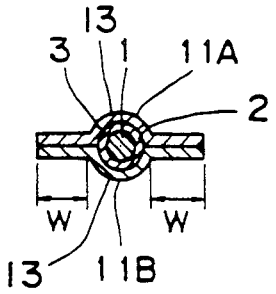
FIG. 2 is a sectional view taken along the line II—II in FIG. 1.
Figure 3:
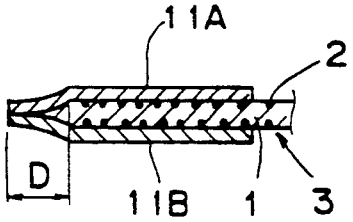
FIG. 3 is a sectional view taken along the line III—III in FIG. 1.

Referring now to the drawings, there is shown in FIGS. 1 to 3, a high-voltage resistance wire 10 employed in a connection construction according to one embodiment of the present invention. In the same manner as in a prior art high-voltage resistance wire shown in FIG. 6, a winding conductor 3 having a high electric resistance is prepared by winding around an insulating core 1 a resistance wire 2 formed by a nichrome wire or the like and then, is coated by an insulating coating layer 4 formed by a thick cylindrical rubber member. Subsequently, the winding conductor 3 and the insulating coating layer 4 are cut to predetermined lengths for cylinder numbers of an automotive engine, respectively. Furthermore, in order to press a terminal 5 against the high-voltage resistance wire 10, the insulating coating layer 4 is stripped, through a fixed length from its cut end, from the winding conductor 3 so as to expose a portion of the winding conductor 3 at a distal end portion of the high-voltage resistance wire 10 as in the prior art high-voltage resistance wire of FIG. 6.

As shown in FIG. 1, a contact piece 12 constituted by an upper metal piece 11A and a lower metal piece 11B is secured to the exposed portion of the winding conductor 3. Each of the upper and lower metal pieces 11A and 11B has an elongated platelike shape and is formed, at an intermediate portion of the contact piece 12 in an axial direction L of the winding conductor 3, with an outwardly projecting semicircular protrusion 13. The upper and lower metal pieces 11A and 11B interpose the winding conductor 3 therebetween and are pressed against each other so as to be secured to each other. In this state, the winding conductor is interposed between the upper and lower metal pieces 11A and 11B along a centerline in the widthwise direction of the upper and lower metal pieces 11A and 11B such that the upper and lower metal pieces 11A and 11B laterally extend through a distance W from the protrusion 13 at opposite sides of the axis L of the winding conductor 3 as shown in FIG. 2. Meanwhile, the upper and lower metal pieces 11A and 11B longitudinally project through a distance D from a distal end of the winding conductor 3 as shown in FIG. 3.

The winding conductor 3 is completely enclosed in the contact piece 12 constituted by the upper and lower metal pieces 11A and 11B such that the upper and lower metal pieces 11A and 11B are pressed against the winding conductor 3. An area of contact of the contact piece 12 with the resistance wire 2 formed by the nichrome wire or the like is large.

Figure 4:
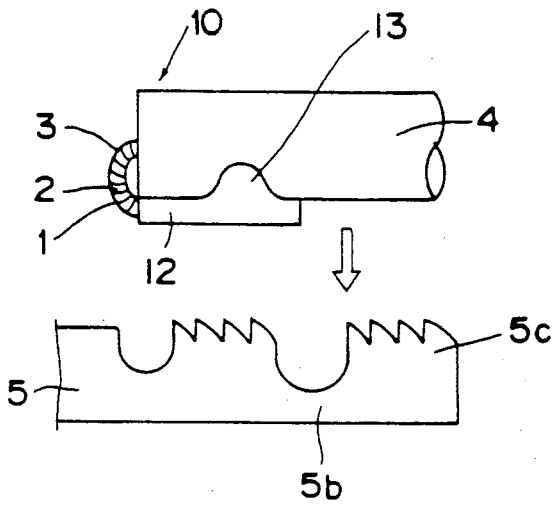
FIG. 4 is a front elevational view showing mounting of the high-voltage resistance wire of FIG. 1 on a terminal.
Figure 5:
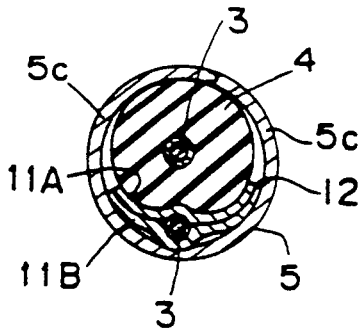
FIG. 5 is a sectional view showing connection between the high-voltage resistance wire and the terminal of FIG. 4.
Figure 8:
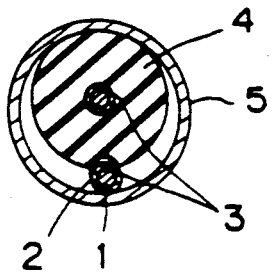
Fig. 8 PRIOR ART
FIG. 8 is a sectional view of the prior art connection construction of FIG. 6(*d*) (already referred to).
Figure 6A:
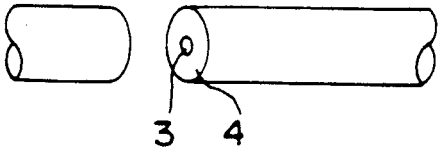
FIGS. 6(*a*) to 6(*d*) are views showing processes for producing a prior art connection construction of a high-voltage resistance wire (already referred to)
Figure 6B:
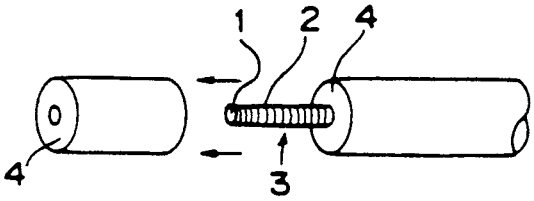
Figure 6C:
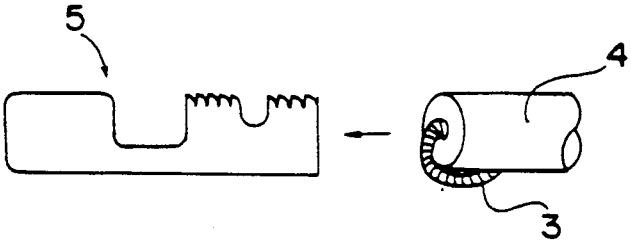
Figure 6D:
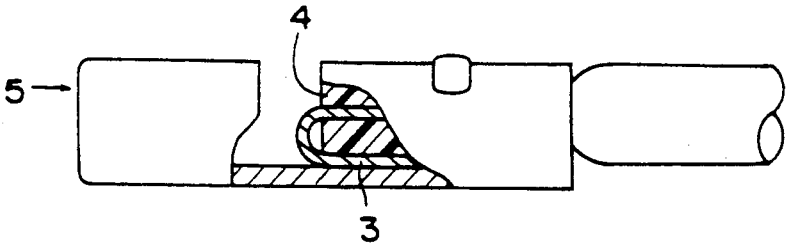
Figure 7A:
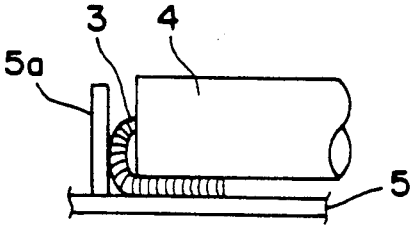
Fig. 7(a) PRIOR ART
FIGS. 7(*a*) and 7(*b*) are views showing two modifications of the prior art connection construction of FIG. 6(*d*), respectively (already referred to)
Figure 7B:
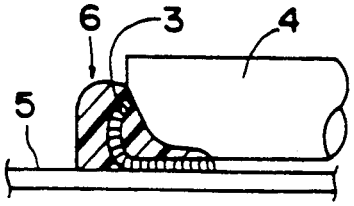
Fig. 7(b) PRIOR ART

After the winding conductor 3 has been bent along the cut end face of the insulating coating layer 4 as shown in FIG. 4 in a state where the upper and lower metal pieces 11A and 11B are secured to each other, the winding conductor 3 is folded back along an outer peripheral surface of the insulating coating layer 4. In this state, the high-voltage resistance wire 10 is inserted into a pressing contact portion 5*b* of the cylindrical terminal 5. In this state, a pair of barrels 5*c* which are provided at opposite ends of the pressing contact portion 5*b*, respectively are fitted around the insulating coating layer 4 so as to be crimped. Thus, as shown in FIG. 5, the contact piece 12 folded back to the underside of the insulating coating layer 4 is pressed between an outer periphery of the insulating coating layer 4 and an inner periphery of the terminal 5 so as to be curved in an arcuate shape. As a result, the upper metal piece 11A of the contact piece 12 is brought into contact with the insulating coating layer 4, while the lower metal piece 11B of the contact piece 12 is brought into facial contact with an inner bottom surface of the terminal 5. In addition, the protrusions 13 projecting from the upper and lower metal pieces 11A and 11B, respectively are also pressed against the inner periphery of the terminal 5 and the outer periphery of the insulating coating layer 4.

As described above, since the resistance wire 2 of the winding conductor 3 is brought into contact with the terminal 5 through the contact piece 12 held in contact with the resistance wire 2 and an area of contact between the contact piece 12 and the terminal 5 is made large, contact between the terminal 5 and the winding conductor 3 can be obtained in a large area.

Meanwhile, since an area of contact between the contact piece 12 and the insulating coating layer 4 made of rubber is also large, an elastic force for urging the contact piece 12 towards the terminal 5, which is applied by the insulating coating layer 4, is increased. Therefore, proper connection between the winding conductor 3 and the terminal 5 can be ensured.

Furthermore, since the contact piece 12 is mounted on the winding conductor 3 in a direction for loosening the resistance wire 2 of the winding conductor 3 so as to completely enclose the winding conductor 3, the resistance wire 2 can be prevented from being loosened.

Meanwhile, in this embodiment, the contact piece 12 is constituted by the upper and lower metal pieces 11A and 11B but may also be formed by molding electrically conductive resin such that the molded contact piece is secured to the exposed winding conductor 3. In this case, it is desirable that the molded contact piece has the same shape as that of the contact piece 12 constituted by the upper and lower metal pieces 11A and 11B.

As is clear from the foregoing description, in the present invention, the contact piece is secured to the winding conductor exposed at the distal end of the high-voltage resistance wire so as to be pressed against the terminal such that an area of contact between the winding conductor and the terminal is increased through the contact piece. Thus, in accordance with the present invention, proper connection between the winding conductor and the terminal can be ensured.

As a result, even if heat deterioration of rubber of the insulating coating layer causes drop of elasticity of the insulating coating layer and contraction of volume of the insulating coating layer, an area of contact between the contact piece and the terminal is quite large. Therefore, improper connection between the winding conductor and the terminal can be prevented and it is possible to guarantee proper connection between the winding conductor and the terminal for a term approximately identical with service life of the engine.

Furthermore, since the contact piece for increasing an area of contact between the winding conductor and the terminal encloses the winding conductor in the direction for loosening the resistance wire of the winding conductor, occurrence of leak due to loosening of the resistance wire can be prevented completely.

What is claimed is:

1. A connection construction of a high-voltage resistance wire, in which an insulating coating layer is stripped from a distal end portion of the high-voltage resistance wire so as to expose a portion of a winding conductor constituted by an insulating core and a resistance wire wound around said insulating core;

wherein a contact piece is mounted on the portion of said winding conductor so as to enclose the portion of said winding conductor in a state where said contact piece is pressed against the portion of said winding conductor;

wherein the portion of said winding conductor is folded back onto said insulating coating layer such that said contact piece is brought into facial pressing contact with a terminal.

2. A connection construction as claimed in claim 1, wherein said contact piece is constituted by a pair of metallic platelike members.

3. A connection construction as claimed in claim 1, wherein said contact piece is made of electrically conductive resin.

4. A connection construction as claimed in claim 1, wherein a pair of protrusions are formed at an intermediate portion of said contact piece in an axial direction of said winding conductor so as to project in opposite directions perpendicular to the axial direction of said winding conductor, respectively;

said contact piece having a flat plate portion so as to be brought into facial pressing contact with said terminal through said flat plate portion and said protrusions.

* * * * *